United States Patent [19]

Leith

[11] Patent Number: 4,712,745

[45] Date of Patent: Dec. 15, 1987

[54] ROTATING DISC WOOD CHIP REFINER

[76] Inventor: William C. Leith, Box 157, Trail, British Columbia, Canada, V1R 4L4

[21] Appl. No.: 767,121

[22] Filed: Aug. 19, 1985

[30] Foreign Application Priority Data

Jun. 6, 1985 [CA] Canada ..... 483274

[51] Int. Cl.[4] ..... B02C 7/08; B02C 7/12

[52] U.S. Cl. ..... 241/261.3; 241/296

[58] Field of Search ..... 241/244, 250, 251, 253, 241/260, 261.2, 261.3, 296

[56] References Cited

U.S. PATENT DOCUMENTS 3,815,834 6/1974 Gilbert ..... 241/296 X 4,039,154 8/1977 Peterson ..... 241/296 X

*Primary Examiner*—Timothy V. Eley

[57] ABSTRACT

In a rotating disc wood chip refiner having a number of refiner plates with a grid of radial bars and slots with a multiplicity of dams in the slots, the dams are spaced in outwards decreasing increments forming a continuous series of resonant cavities, and the radial bars are radially and uniformly skewed backwards at a radial angle of about 1.5 degrees to disc rotation. These improvements provide a reduced energy input by means of a resonating cavity flow regime, together with a low fluid-dynamic drag radial bar profile and a pressure recovery radial slot profile.

9 Claims, 6 Drawing Figures

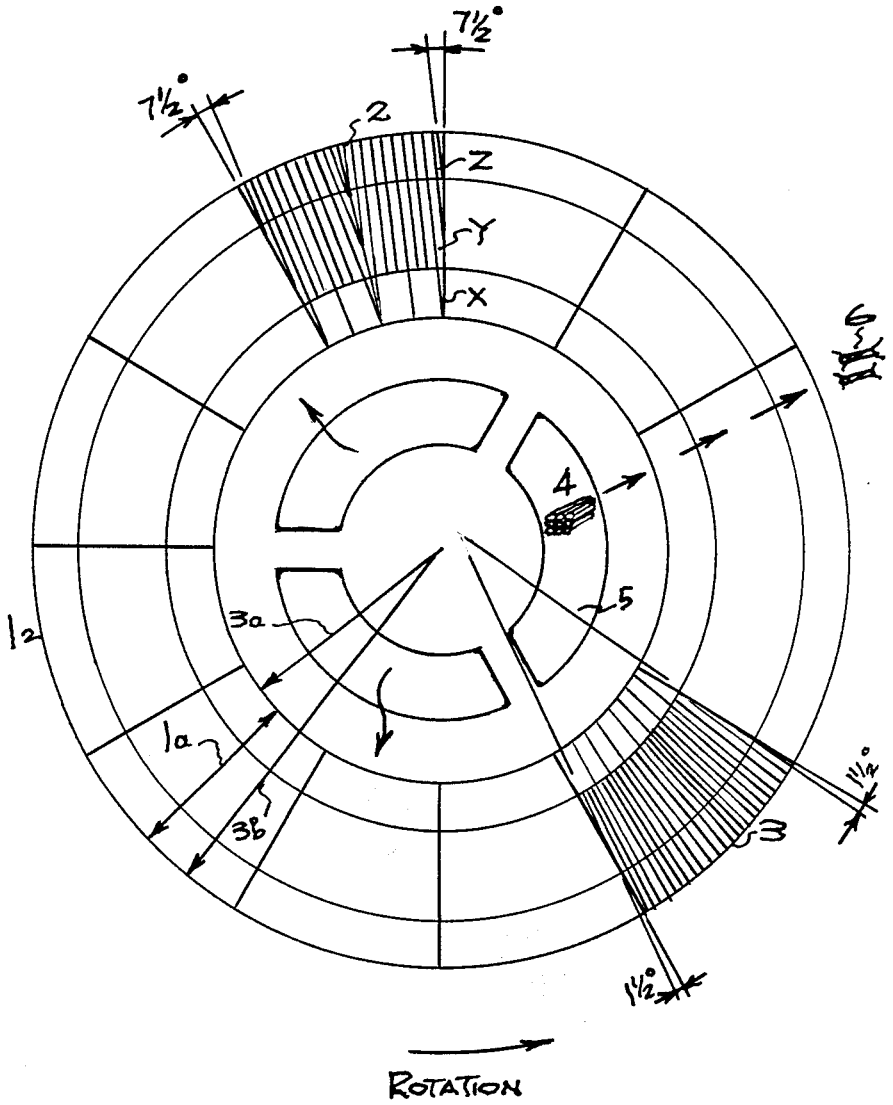
FIGURE I

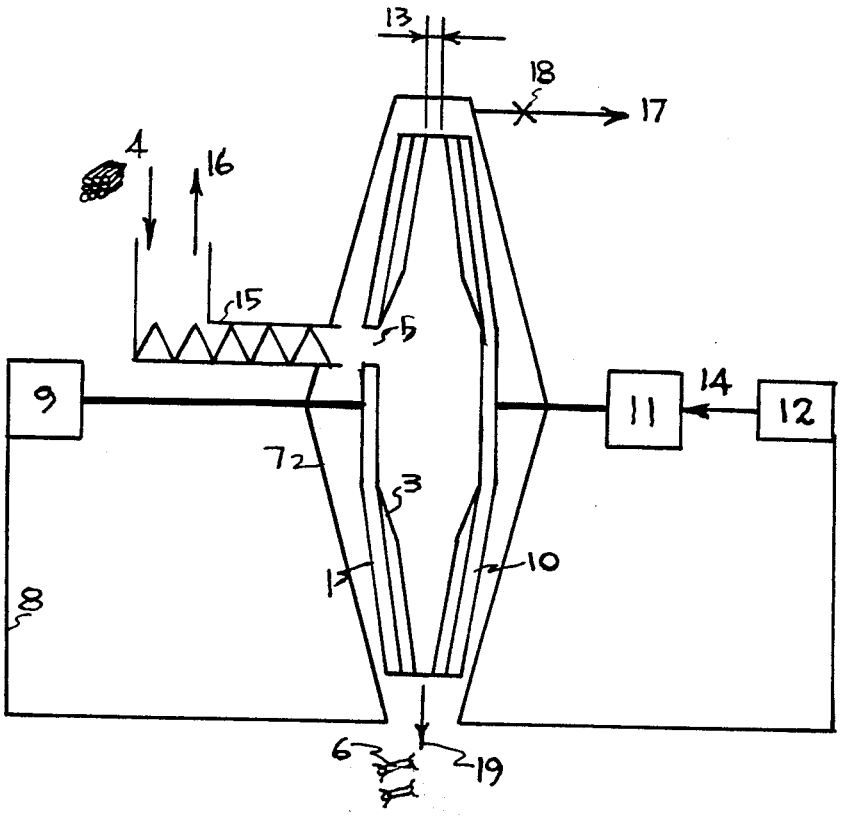
FIGURE II

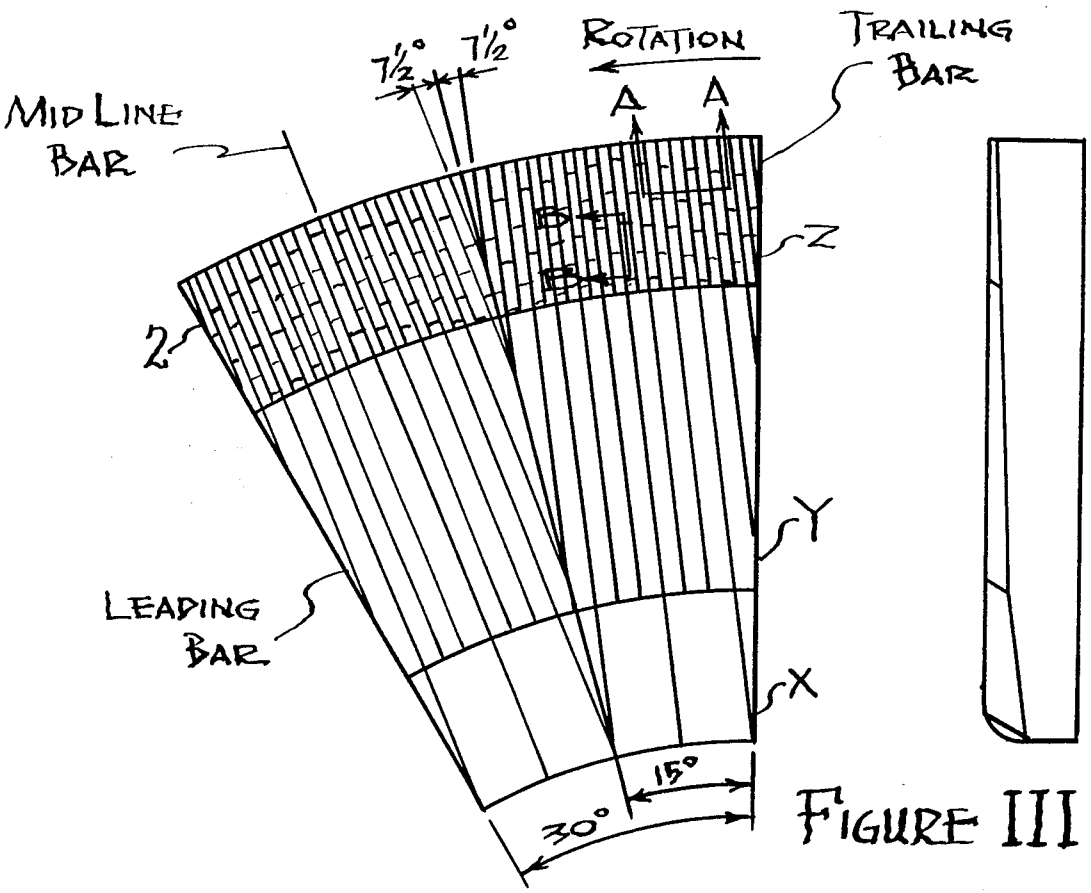
FIGURE III
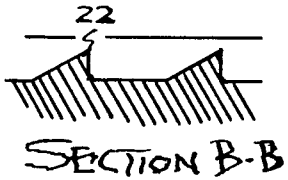
SECTION B-B
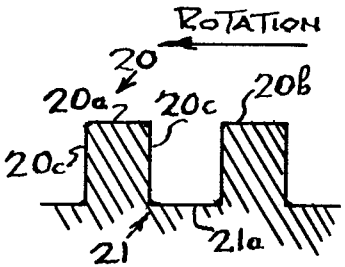
SECTION A-A

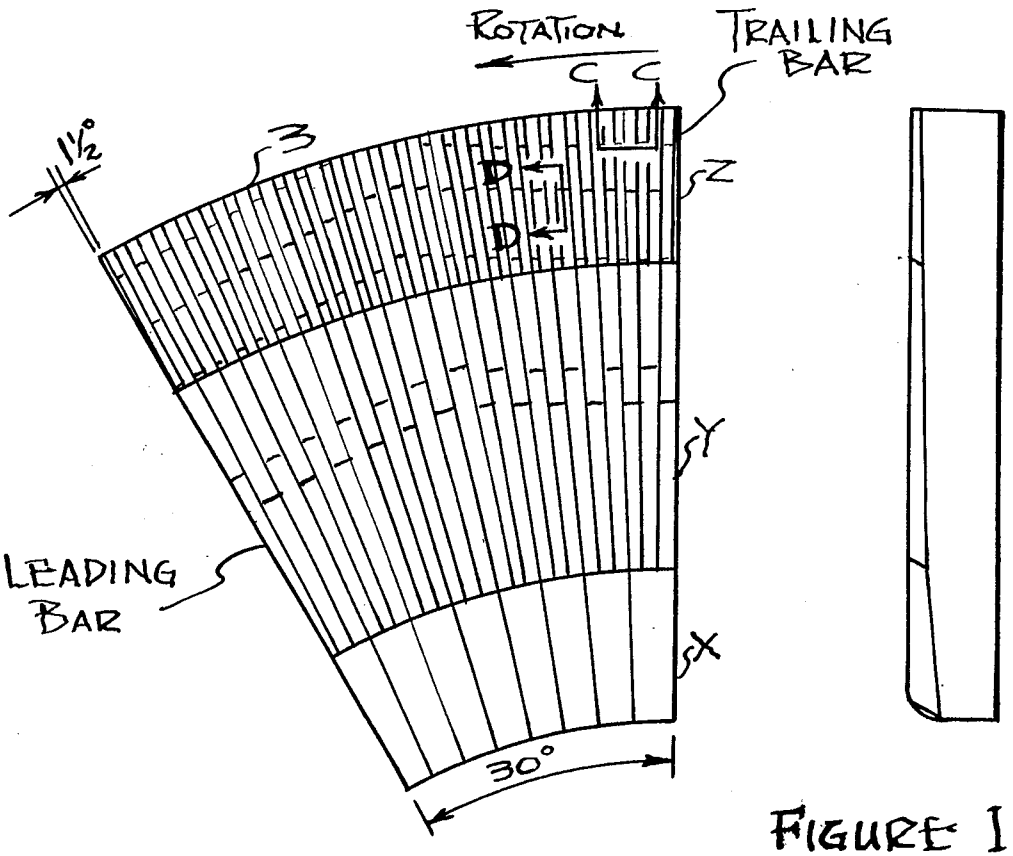
FIGURE IV
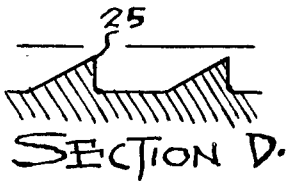
SECTION D-D
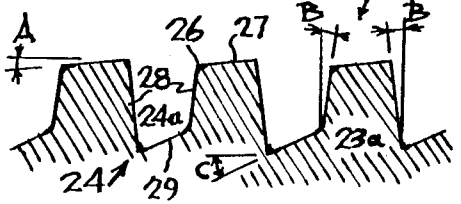
SECTION C-C

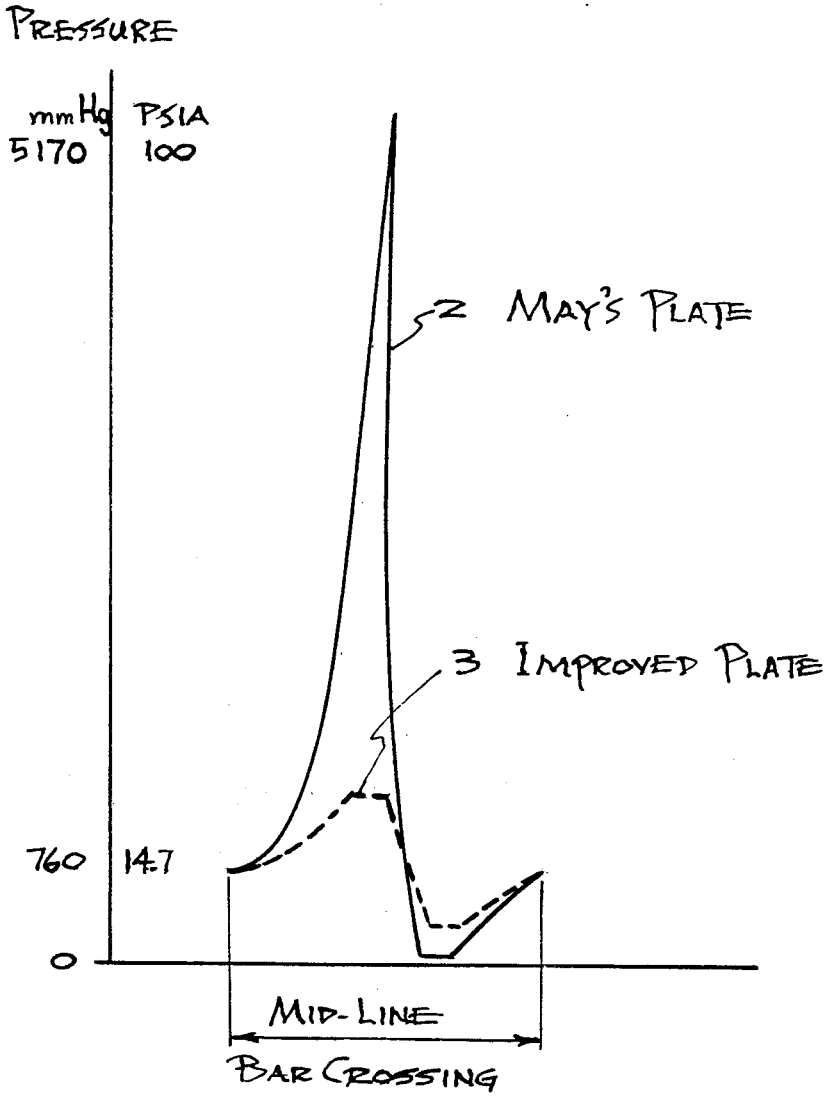
FIGURE V

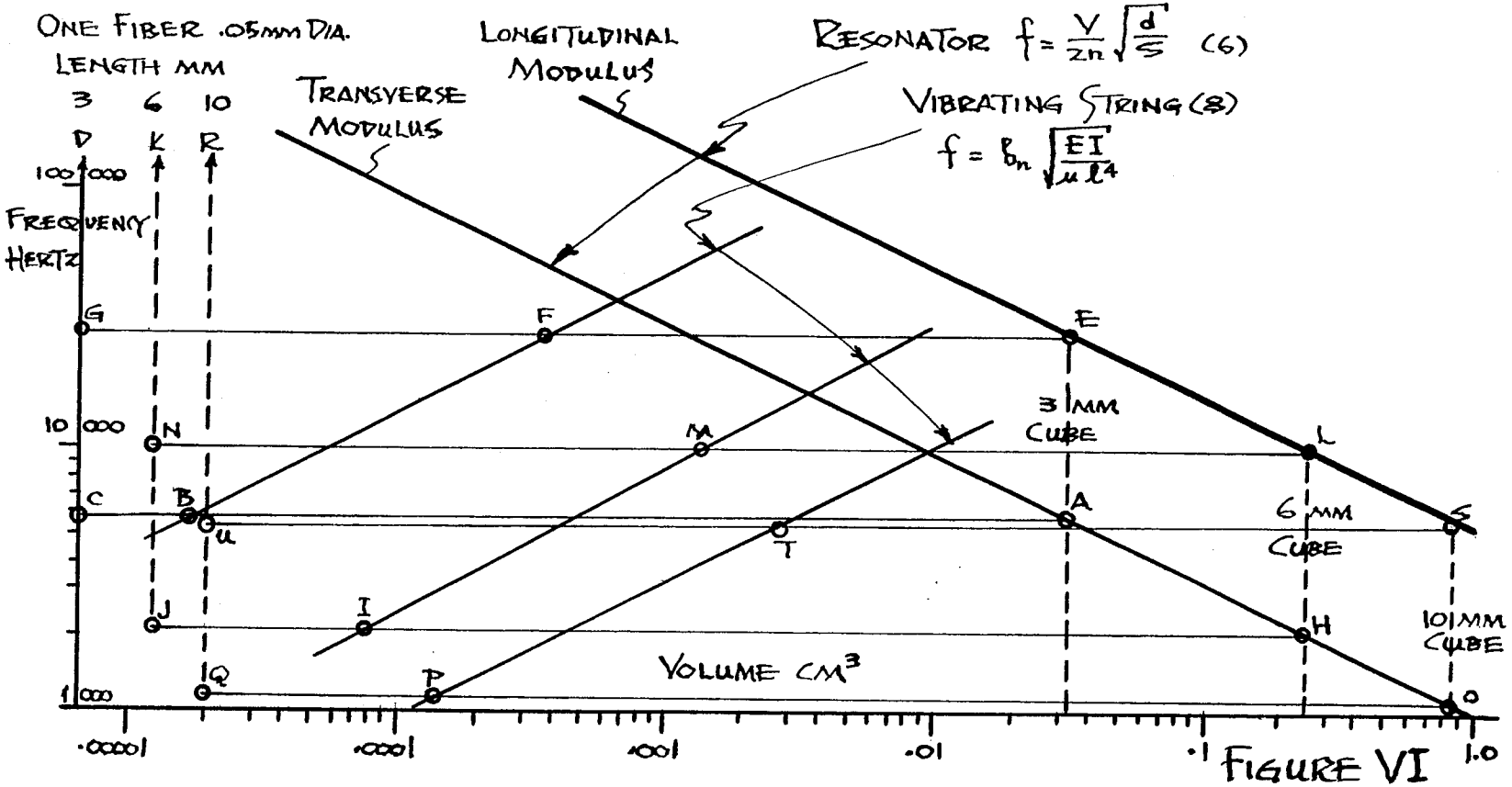
FIGURE VI

ROTATING DISC WOOD CHIP REFINER

This invention relates to rotating disc wood chip refiner apparatus which is useful for the separation of wood chips into unravelled single long fibers to achieve better pulp and paper sheet formation by improved refiner plate design, utilizing a resonating cavity model of wood refining with a low fluid-dynamic drag radial bar profile and a pressure-recovery radial slot profile to reduce energy input and to improve loadability.

As mandatory economic restraints for the conservation of energy resources become more stringent, the methods and apparatus for achieving minimum energy input by reducing the wasted fluid-dynamic drag energy in rotating disc wood chip refiners must become more sophisticated to meet the demands of upward spiralling energy costs.

In the wet separation and unravelling of wood fibers, wood chip fragments over a range of sizes must be refined simultaneously within a bar/slot length of about 30 cm (1 foot), a task that usual rotating disc wood chip refiners with square, sharp-edged radial bar/slot profiles perform with much wasted fluid-dynamic drag energy. However, various additional techniques to the usual rotating disc wood chip refiner may provide the necessary means to halve the usual fluid drag energy. Such techniques involve an improved refiner plate design utilizing a resonating cavity model of wood refining with a low fluid-dynamic drag radial bar profile to provide the required cavitation regime with less than 50% of the usual square bar drag energy; and a pressure-recovery radial slot profile requiring less than 50% of the usual square slot drag energy. Improved loadability results when the nomial motor energy input can refine a greater capacity of wood chips.

There are three distinct regions of resonance in a rotating disc wood chip refiner, see FIG. I:

Zone X—an inner breaker zone at 500 to 1000 hertz

Zone Y—an intermediate refinery zone at 2000 to 10,000 hertz

Zone Z—an outer refiner zone at 10,000 to 30,000 hertz

Theoretical performance of the present invention will provide a minimum energy input to a rotating disc wood chip refiner by means of a resonating cavity flow regime, combined with a low fluid-dynamic drag radial bar profile and a pressure-recovery radial slot profile with several advantages:

(a) A self-sustaining oscillation of flow past the radial bar/slot cavity called a tuned resonating cavity provides the lowest possible energy input due to a tuned resonance condition.

(b) A low fluid-dynamic drag radial bar profile can provide the required pulsating cavitation regime with less than 50% of the input energy for usual square radial bar profiles.

(c) A pressure-recovery radial slot profile reduces flow separation and reciculation, besides pressure recovery benefits, with less than 50% of the input energy for usual square radial slot profiles.

The pioneer work of Forgacs (5) on the characterization of mechanical pulping was combined with Atack's (1) classic observations on fiber orientations in a rotating disc wood chip refiner to establish an improved rotating disc wood chip refiner, utilizing a resonating cavity model of wood refining, with a low fluid-dynamic drag radial bar profile and a pressure-recovery radial slot profile, to reduce energy input and improve loadability. Colby (6) reported data on acoustic velocities in wood, water, steam, and air which confirm that wood chips 10 mm cubes down to single wood fibers 0.05 mm diameter by 3 mm long can respond to 800 hertz at the inner disc radius, and 30,000 hertz at the outer disc radius of 750 mm.

Harmonic vibration theory suggests four stages of wood chip separation and defibrillation per Atack (1):

(a) match stick fractures along the grain axis, longitudinal, of the fiber length.

(b) fiber bundles with broomed ends.

(c) single fibers separated between the longitudinal-oriented $S_2$ layer and the transverse-oriented $S_1$ layer/-middle lamella layer.

(d) single fiber unravelling on the spiral seam of the longitudinal-oriented $S_2$ layer.

Harmonic vibration theory confirms Atack's (1) report that refiner mechanical pulping involves tangential fiber orientation of wood chips and matchsticks in the inner refiner zone, and more radial fiber orientation of fiber bundles and single fibers in the outer refiner zone. Lin (7) has described boundary layer effects in hydrodynamic stability for the pulsating radial bar/slot cavity. Rockwell (4) reported a complete review of self-sustained oscillation of flow past the pulsating radial bar/slot cavity.

Self-sustaining oscillations of flow past the radial bar/slot cavity established a tuned resonating cavity with three distinct aspects of minimum energy:

(a) Fluid-dynamic oscillations of the radial bar/slot resonating cavity are related to high drag for a square, sharp-edged bar and low drag for a low fluid-dynamic drag profile.

(b) Fluid resonant oscillations of the wood chip in the cavity permit resonance for wood chips 10 mm cubes down to single wood fibers 0.05 mm diameter by 3 mm long with a frequency response 800 to 30,000 hertz.

(c) Fluid elastic oscillations of the broomed fiber as a vibrating string, see Archibald (8), involve the separation of a wood fiber tethered to a wood chip by a longitudinal shear failure between the longitudinal-oriented $S_2$ layer and the transverse-oriented $S_1$ layer/middle lamella layers. Unravelling of a separated wood fiber occurs along its spiral seam of the longitudinal-oriented $S_2$ layer, with broomed ends.

A resonant cavity model of wood refining in a rotating disc wood chip refiner utilizes a family of resonant harmonic vibrations, which totalize three self-sustaining oscillations of flow past a radial bar/slot cavity, at multiple radial bar/slot crossings, at frequencies 800 (disc center) to 30,000 (disc rim), hertz, as reported by Rockwell (4).

(a) Fluid-dynamic oscillations mainly due to the radial bar profile provide the required pulsating cavitation regime of pressure/vacuum cycles at multiple radial bar/slot crossings, and are related to inherent hydrodynamic instability with amplification of the cavity shear layer and possible feedback mechanisms.

(b) Fluid-resonant oscillations mainly due to the radial slot profile provide the tuned resonant cavity mode for various sized wood chips—10 mm ($\frac{3}{8}$ inch) cubes down to wood fibers 0.05 mm (0.002 inch) diameter by 3 mm ($\frac{1}{8}$ inch) long, and for slot resonance with internal dams forming a series of resonance cavities when filled with any combination of wood chips, wood fibers, water, steam or air.

(c) Fluid-elastic oscillations mainly due to the radial bar/slot edge profiles provide a coupling of elastic, inertia, and damping properties for elastic deformations of solid boundaries.

Practical experience with usual rotating disc wood chip refiners with square, sharp-edged radial bar/slot profiles about 3 mm by 3 mm in cross-section require a 20,000 hertz bar-crossing frequency with a 0.05 mm rim gap to create the pulsating cavitation regime to separate wood chips into unravelled single wood fibers, with several disadvantages:

(a) a high power input due to wasted energy with large fluid-dynamic drag, much noise, and considerable erosion loss with an untuned resonating cavity.

(b) a short cyclic residence time of 0.00001 second at 20,000 hertz for the required cavitation regime with a transient, random bubble-cavitation cloud created by square, sharp-edged radial bar profiles.

(c) undesirable flow separation and recirculation, besides little pressure recovery benefits with square, sharp-edged radial slot profiles.

It is therefore an object of the present invention to provide an improved rotating disc wood chip refiner utilizing a resonating cavity model of wood refining, with fluid-dynamic drag radial bar profile, and a pressure-recovery radial slot profile to reduce energy input and to improve loadability.

The present invention provides a rotating disc wood chip refiner in which two circular discs, sometimes one stationary disc and one rotating disc and other times two contra-rotating discs, refine wood chips in a tapered gap between the two discs. The gap tapers from 40 mm at the center feed to perhaps 0.1 mm at the outer rim. Each disc has a grid of radial bars/slots, which during rotation provide multiple bar crossings that initiate a tuned resonating cacity flow regime , see Rockwell (4), with 800 to 30,000 hertz pressure/vacuum cavitation cycles. Wood chips from 10 mm cubes down to single fibers 0.05 mm diameter by 3 mm long, can respond in resonant harmonic vibrations to the tuned resonating cavity created by self-sustaining oscillations of flow past the radial bar/slot cavity. The single fibers or clusters of fibers separate from the wood chip by a compression/shear buckling failure of the bond material between fibers, and agree with Atack's classic observations of wood fibers (1).

The math model for a resonating cavity model of wood chip refining in an improved rotating disc wood chip refiner was completed under the B.C. Science Council Grant No. 4B (RC-6) 1982–1983, see (16).

Rotating Disc Wood Chip Refining

Wood chip separation and defibrillation into single wood fibers with unravelled ends occurs at radial bar/-slot crossings due to a pulsating cavitation (pressure/-vacuum) regime related to the radial bar/slot profile, pattern and orientation, and the tapered gap between the opposed refiner plate segments mounted on two opposed circular discs. Less than 10% of the input energy is converted into useful work of wood separation and defibrillation; hence the economic incentive to reduce the wasted fluid-dynamic drag energy loss.

A. Beating Theory of Wood Refining

May's work (10) will be used as a bench-mark of the beating theory of wood refining, see FIG. I, in which a parallel pattern of radial bars/slots cover a 15 degree segment of a total 30 degree refiner plate segment. Table I indicates the radial bar/slot crossing angles at the leading, mid-line, and trailing radial bars which produces an outward/inward pressure surge as opposing refiner plate segments cross each other. Only the midline radial bar is truly radial to the rotating disc center, so that the leading radial bar leans backward at 7½ degrees, and the trailing radial bar leans forward at 7½ degrees, which produces the outward/inward radial pressure surge. Thus, a mixture of wood chips, wood fibers, water, steam, and air in a specific slot on the first refiner disc plate receives an outward/inward radial pressure surge as the opposed refiner disc plate crosses, due to the parallel radial bar/slot pattern. May (10) reported that a peak of self-pressurization of steam flow in wood chip refiners cause about half of the steam to move in forward/outward radial flow and half in back-/inward radial flow.

B. Resonant Cavity Theory of Wood Refining

One of the objects of this invention is to utilize an optimized resonant cavity theory of wood refining with a minimum energy condition by a family of resonant harmonic vibrations. A quasi-steady outward radial pressure and velocity provides the same residence time as May's refiner plate, without the wasted fluid-dynamic drag energy loss caused by the outward/inward radial pressure surge at each refiner plate crossing. This invention has all radial bars/slots skewed backward at 1½ degrees radial angle to disc rotation, which produces the quasi-steady outward radial pressure and velocity. The important design criteria for a resonant cavity theory of wood refining are:

a. the transverse wave velocity in the wood chip/fiber enables wood chips from 10 mm (⅜ inch) cube down to single wood fibers 0.05 mm (0.002 inch) diameter by 6 mm long (¼ inch) to respond in a family of resonant harmonic vibrations to the radial bar/slot crossing frequency range of 800 (disc center) to 30 000 (disc rim) hertz. Table 2 lists the transverse wave velocity for various wood species, and the variation between spruce and birch is a design parameter.

b. a low fluid-dynamic drag radial bar profile has been studied for decades, and Hoerner's book (2) lists drag coefficients to produce a specific cavitation intensity with least energy.

c. a pressure-recovery radial slot profile removes the cavitation bubbles with least energy, and Hoerner's book (2) and Adkin (3) list typical drag coefficients.

d. the dams located in radial slots are staggered to provide a continuous series of resonant cavities which can respond anywhere in the radial bar/slot crossing frequency range of 800 (disc center) to 30 000 (disc rim) hertz with a family of resonant harmonic vibrations.

e. the skewed radial 1½ degree backward angle of the radial bar/slot pattern orientation provides the quasi-steady outward radial pressure and velocity with least energy.

f. the skewed radial 1½ degree backward angle of the radial bar/slot pattern orientation provides a minimum of back/inward steam flow and a maximum of forward/outward steam flow with little steam flow reversals at radial bar/slot crossings, hence less wasted fluid-dynamic drag energy loss.

Cellular Standing/Travelling Waves

Prandtl (12) gives a translation of Bjerknes (13) work with modern references, which describes the characteristics of cellular standing/travelling waves of the acoustic type. May's parallel radial bar/slot pattern orientation causes three different cellular waves at bar crossings:

(a) at mid-line strictly radial line crossings, cellular standing waves are produced that may cause a flow restriction called rotating stall.

(b) at radial bar (leaning forward) crossings, inward cellular travelling waves occur with an opening scissors action, which causes the backflow steam.

(c) at radial bar (leaning backward) crossings, outward cellular travelling waves occur with a closing scissors action, which causes the forward flow steam, that is desirable.

May's refiner plate has one advantage in the outward cellular travelling waves; and two disadvantages in the inward cellular travelling waves and the cellular standing waves.

The improved refiner plate has only the outward cellular travelling waves, which produce the quasi-steady pressure condition, with the least energy input.

BRIEF DESCRIPTION OF THE DRAWINGS

FIG. I is a front elevation of a rotating disc 1.

FIG. II is a diagrammatic side elevation of the rotating disc wood chip refiner 7.

FIG. III is a front elevation of a May's refiner plate segment 2.

FIG. IV is a front elevation of a improved refiner plate segment 3.

FIG. V shows pressure gradients at radial bar/slot crossing at the mid-line position on a refiner plate segment.

FIG. VI indicates that usual wood chips can respond themselves as pulsating Helmholtz resonators.

One embodiment of the invention will now be described, by way of example, with reference to the accompanying drawings, of which:

FIG. 1 is a front elevation of a rotating disc 1, having a rim portion 1*a*, with twelve replaceable refiner plate segments, of which May's refiner plate segment 2 shows the parallel radial bar/slot pattern orientation, and the improved refiner plate segment 3, having an inner radius 3*a* and an outer radius 3*b*, shows the skewed radial bar/slot pattern orientation. Wood chips 4 enter the rotating disc 1 through feeder slots 5, and proceed radial outwards and are refined into single unravelled wood fibers 6 which exit at the disc rim. Three zones of refining are indicated: the X breaker zone, the Y intermediate zone, and the Z outer refining zone.

FIG. II is a diagrammatic side elevation, partly in section, of the rotating disc wood chip refiner 7, with a machine frame 8. Two parallel circular discs 1 and 10, having facing surfaces, are mounted concentrically on frame 8. Usually rotating means 9 rotates disc 1, and disc 10 is stationary.

The two discs can both be rotated, and in opposite directions, and additional rotating means 11 rotates disc 10. Rotating disc 1 and disc 10, whether stationary or rotating, therefore, are in relative counter-movement to each other. A hydraulic cylinder 12 provides an adjustment for the disc gap 13 and the disc thrust 14, to suit various refining operations with a variety of wood species. Wood chips 4 are added by a screw feeder 15 through the feeder slots 5, and backflow steam 16 exits at feeder 15. The forward flow steam 17 leaves the refiner 7 at the control valves 18. Refined wood fibers 6 leave the refiner through exit 19.

FIG. III is a front elevation of a May's refiner plate segment 2, with the parallel radial bar/slot grid pattern orientation, and the square sharp-edged radial bar profile 20, and the square sharp-cornered radial slot profile 21, as shown in section A—A. The bars of parallel radial bar profile 20 each have a top surface 20*b*, a leading edge 20*a* at the edge of the top surface 20*b* in the direction of the relative counter-movement or rotation of the discs 1 and 10, and the two vertical side surfaces 20*c*. The slots defined between the bars have a parallel radial profile 21, each slot having a horizontal bottom surface 21*a*. A multiplicity of dams 22, shown in section B—B, are located and spaced in each of the slots of the slot profile 21. The dams 22 are evenly spaced in each slot, but staggered in parallel slots, and at mid-line radial bar crossings, can produce a cellular standing wave that can cause a steam flow restriction called rotating stall. The reversal of steam flow across a refiner plate segment due to the change from inward to outward cellular travelling waves cause condensation chugging with noise and vibration, see Gymarthy (14) and with cavitation attack (15). The grid of bars and slots with dams provide multiple bar-crossings caused by the relative counter-movement of the discs.

FIG. IV is a front elevation of an improved refiner plate segment 3, with the skewed radial bar/slot grid pattern orientation, and the low fluid-dynamic drag radial bar profile 23, and the pressure-recovery radial slot profile 24, as shown in section C—C. The skewed radial bar profile generally indicated at 23 includes skewed radial bars 23*a*, each bar 23*a* having a leading edge 26, a substantially horizontal top surface 27, and two substantially vertical side surfaces 28. Leading edge 26 is the edge of the top surface 27 in the direction of the relative counter-movement or rotation of discs 1 and 10. Leading edge 26 of each bar 23*a* is preferable rounded, such as, for example, with a rounding radius of about 0.015 inch. Top surface 27 is preferably sloped downward at an angle A towards leading edge 26. The angle A of top surface 27 is small, and preferably about 6 degrees. Side surfaces 28 are preferably sloped at an angle B from the vertical such that each bar 23*a* is tapered down towards its top surface 27. The angle B of each side surface 28 is small and preferably about 6 degrees.

The skewed radial slot profile generally indicated at 24 includes radial slots 24*a*, each slot 24*a* having a substantially horizontal bottom surface 29. Bottom 29 is preferably sloped downward from the horizontal at an angle C in the direction of relative counter-movement or rotation of discs 1 and 10. The angle of C of bottom 29 is preferablk about 25 degrees. Generally, the angles A, B, and C should be such that the fluid-dynamic drag energy required for relative counter-movement or rotation will be reduced. The preferred values of angles A,B, and C given above will reduce the fluid-dynamic drag energy by about 50% of the energy required for the square-edged radial bar and slot profiles of the prior art refiner plates.

It is noted that the bar crossing angle of the refiner plate of the invention is constant, i.e., for a radial skewed angle of about 1.5 degrees on each disc, the bar crossing angle is constant at about 3 degrees. For the parallel bar and slot profiles of the refiner plates according to the prior art, the bar crossing angle varies from zero degrees to as high as 50 degrees. The dams 25, as shown in section D—D, are spaced in radial outwards decreasing increments, i.e., continuously decreasing distances between dams to form a continuous series of resonant cavities. The size of each cavity is defined by the spacing between two adjacent bars and the distance between two consecutive dams. Preferably, the increments are such that the slot between the bars respond to the multiple bar crossings at a resonant frequency ranging from about 800 hertz at the inner radius 3*a* of the refiner plates 3 to about 30,000 hertz at the outer radius 3*b* of the refiner plates 3.

FIG. V shows the pressure gradients at radial bar/-slot crossings at the mid-line position on a refiner plate segment, where May's parallel pattern 2 gives a much higher pressure gradient than the improved skewed pattern 3.

FIG. VI indicates that usual wood chips—3 mm, 6 mm, and 10 mm cubes—can respond themselves as pulsating Helmholtz resonators in the frequency range 800 to 30,000 hertz, found in practical rotating disc wood chip refiners, along both the longitudinal fiber axis and the lateral fiber axis:

(a) 3 mm cubes are resonant in the lateral fiber axis at 5500 hertz (A), separate into match sticks which respond as vibrating strings moving to (B), reaching single fibers which unravel from (C) to (D).

(b) 3 mm cubes are resonant in the longitudinal fiber axis at 27,000 hertz (E), separate into match sticks which respond as vibrating strings moving to (F), reaching single fibers which unravel from (G) to (D).

(c) 6 mm cubes are resonant in the lateral fiber axis at 2100 hertz (H), separate into match sticks which respond as vibrating strings moving to (I), reaching single fibers which unravel from (J) to (K).

(d) 6 mm cubes are resonant in the longitudinal fiber axis at 10,000 hertz (L), separate into match sticks which respond as vibrating strings moving to (M), reaching single fibers which unravel from (N) to (K).

(e) 10 mm cubes are resonant in the lateral fiber axis at 1150 hertz (O), separate into match sticks which respond as vibrating strings moving to (P), reaching single fibers which unravel (Q) to (R).

(f) 10 mm cubes are resonant in the longitudinal fiber axis at 5200 hertz (S), separate into match sticks which respond as vibrating strings moving to (T), reaching single fibers which unravel from (U) to (R).

TABLE I

Wave Velocity of Refiner Plate Materials Referred to Transverse Young's Modulus of Wood

| | Wave Velocity $V = \sqrt{\frac{E}{P_m}}$ |
|---|---|
| Steel 1025 | 513% |
| Cast iron GA | 436% |
| Birch | 54% |
| Jackpine | 99% |
| Spruce | 100% |
| Fir | 86% |
| Tamarack | 90% |
| Oak | 80% |
| Teak | 85% |
| Nylon | 189% |
| Polyester resin | 249% |
| Polyester and glass rovings | 463% |
| Polyester and glass cloth | 308% |
| Polyester and chopped glass strand | 262% |
| Air | 33/66/99% |
| Water | 144% |
| Steel | 40/80/120% |

TABLE II

Radial Bar/Slot Crossing Angles

| | | May's Plate | | | Improved Plate | | |
|---|---|---|---|---|---|---|---|
| Pattern | | Parallel | | | Skewed | | |
| Orientation | | | | | | | |
| Leading L | | +7½° backward | | | 1½° backward | | |
| Mid-line M | | 0 | | | " | | |
| Trailing T | | −7½° forward | | | " | | |
| Bar drag | | 100% | | | 50% | | |
| Slot drag | | 100% | | | 50% | | |
| Bar Crossing Angles | | | | | | | |
| First Plate | | L | M | T | L | M | T |
| Second Plate | L | 15° | 7½° | 0 | 3° | 3° | 3° |
| | M | 7½° | 0 | −7½° | 3° | 3° | 3° |
| | T | 0 | −7½° | −15° | 3° | 3° | 3° |
| Mean outward radial velocity of wood fibers | | 10 fps<br>3 m/s | | | 10 fps<br>3 m/s | | |

REFERENCES

1. D. N. Atack and W. D. May, Fracture of Wood, *Pulp and Paper Mag Canada,* 64C, T75-83, 119, 1963.
2. S. F. Hoerner, *Fluid Dynamic Drag,* New Jersey, 1965.
3. R. C. Adkins et al, The Hybrid Diffuser, *ASME Jour Eng Power* vol. 103, Jan. 1981.
4. D. Rockwell and E. Naudascher, Self-Sustaining Oscillations of Flow Past Cavities, ASME Jour Fluids Eng. vol. 100 no. June 2, 1978.
5. Forgacs, Characterization of Mechanical Pulps, *Pulp and Paper Mag Canada,* T-89, Conv Issue 1961.
6. M. Y. Colby, Sound Waves and Acoustics, Henry Holt, New York, 1934.
7. C. C. Lin, *Theory of Hydrodynamic Stability,* Cambridge University Press, 1961.
8. F. R. Archibald and A. G. Emslie, The Motion of a String Having a Uniform Motion along its Length, *ASME Jour* App Mech. 1959.
9. L. L. Beranek, *Noise and Vibration Control,* McGraw Hill, New York, 1971.
10. W. D. May et al, The Flow of Steam in Chip Refiners, Inst. Paper Chem, Appleton Wisc. September 1980.
11. U.S. Govt. Wood Handbook, Forest Products Lab. Agricultural Handbook, No. 72 August 1974. LCCC-No. 73-60035
12. Prandtl, L. Essentials of Fluid Dynamics, Hafner Publ. New York, 1952.
13. Bjerknes, V. Physikalische Hydrodynamik, Springer, Berlin, 1923.
14. Gymarthy, C. Condensation Shock Diagrams for Steam Flow, Forsch Ang. Wes. 29(4), 1963.
15. Leith, W. C., Steam Flow Instabilities Accelerate Conjoint Cavitation/Corrosion/Erosion Attack, Eng. Digest, April 1973.
16. Leith, W. C. Improved Refiner Plate Design To Reduce Energy and Improved Loadability in Rotating Disc Wood Refiners (TMP), B.C. Science Grant No. 48(RC-6) 1982–1983 (math model).

I claim:

1. A refiner plate for a rotating disc wood chip refiner apparatus, said apparatus including a frame; two parallel circulardiscs having facing surfaces and mounted concentrically on said frame; means for rotating at least one of said discs, having a direction of rotation, for relative counter-movement of said discs to each other; each disc having a rim portion; each said disc having a multiplicity of refiner plates forming adjacent segments of and mounted on said rim portion of said facing surfaces; each refiner plate having an inner radius and an outer radius, a grid of radial bars and slots defined between said bars; each said radial bar having a leading edge in the direction of said relative counter-movement. a substantially horizontal top surface and two substantially vertical side surfaces; each said slot having a substantially horizontal bottom surface between vertical side surfaces of adjacent bars; a multiplicity of dams located and spaced in each said slot but staggered in parallel slots; and said grid of bars and slots with dams providing multiple bar-crossings caused by said relative counter-movement of said discs to each other, characterized in that said dams are spaced in radial (outwards) outwardly decreasing increments, said increments forming a continuous series of resonant cavities; and said radial bars and slots therebetween are radially and uniformly skewed backwards at a radial angle of about 1.5 degrees to disc rotation in the direction of said relative counter-movement, the backwardly skewed bars and slots on the one disc being skewed in a direction opposite to the backwardly skewed bars and slots on the other disc.

2. A refiner plate as claimed in claim 1, characterized in that one of said discs is stationary, the other of said discs is rotated by said means for rotating, each said radial bar of said refiner plates mounted on the rotating disc has a leading edge in the direction of rotation, and each said radial bar of said refiner plates mounted on the stationary disc has a leading edge in a direction opposite to the direction of rotation of said rotating disc.

3. A refiner plate as claimed in claim 1, characterized in that both said discs are rotated by said means for rotating, the rotation of one disc being counter to the rotation of the other disc, and said radial bars having a leading edge in the direction of rotation.

4. A refiner plate as claimed in claim 1, characterized in that said increments are such that the slots between said bars respond to said multiple bar-crossings at a resonant frequency ranging from about 800 hertz at said inner radius of said refiner plate to about 30,000 hertz at said outer radius of said refiner plate.

5. A refiner plate as claimed in claim 1, characterized in that said substantially horizontal top surface of said bars is sloped downwards towards said leading edge of each bar.

6. A refiner plate as claimed in claim 1, characterized in that said substantially vertical side surfaces of said bars are each sloped at an angle from the vertical such that each bar is tapered down towards said top surface.

7. A refiner plate as claimed in claim 1, characterized in that said substantially horizontal bottom of said slots is sloped downward from the horizontal at an angle in the direction of rotation.

8. A refiner plate as claimed in claim 1, characterized in that said leading edge of each said bar is rounded.

9. A refiner plate as claimed in claim 1, 4, or 5, characterized in that said substantially horizontal top surface of said bars is sloped downward towards said leading edge of each bar at an angle of about 6 degrees, said substantially vertical side surfaces of said bars are each sloped at an angle of about 6 degrees from the vertical such that each bar is tapered down towards said top surface, and said substantially horizontal bottom of said slots is sloped downward from the horizontal at an angle of about 25 degrees in the direction of rotation.

* * * * *